US008418682B2

(12) United States Patent
Halmone

(10) Patent No.: US 8,418,682 B2
(45) Date of Patent: Apr. 16, 2013

(54) SYSTEM FOR LOADING A PAINTBALL

(75) Inventor: Fabrice N. V. Halmone, Ville la Grand (FR)

(73) Assignee: Kingman International Corporation, Baldwin Park, CA (US)

( * ) Notice: Subject to any disclaimer, the term of this patent is extended or adjusted under 35 U.S.C. 154(b) by 0 days.

(21) Appl. No.: 13/232,915

(22) Filed: Sep. 14, 2011

(65) Prior Publication Data

US 2013/0061840 A1 Mar. 14, 2013

(51) Int. Cl.
*F41B 11/02* (2006.01)

(52) U.S. Cl.
USPC ..... 124/84; 124/82; 124/83

(58) Field of Classification Search ..... 124/45, 124/47, 49, 71, 82, 83, 51.1
See application file for complete search history.

(56) References Cited

U.S. PATENT DOCUMENTS

| | | | | |
|---|---|---|---|---|
| 5,425,298 | A * | 6/1995 | Coburn | 89/14.3 |
| 6,470,872 | B1 | 10/2002 | Tiberius et al. | |
| 6,701,909 | B2 | 3/2004 | Tiberius et al. | |
| 6,892,718 | B2 | 5/2005 | Tiberius et al. | |
| 2005/0241628 | A1 * | 11/2005 | Hatcher | 124/82 |
| 2010/0282229 | A1 * | 11/2010 | Tran | 124/71 |

OTHER PUBLICATIONS

Tiberius Arms, "Tiberius Arms Technical Manual", 12 pages.

* cited by examiner

*Primary Examiner* — Stephen M Johnson
*Assistant Examiner* — John D Cooper
(74) *Attorney, Agent, or Firm* — Blakely, Sokoloff, Taylor & Zafman LLP

(57) ABSTRACT

The plural option loading system for a pneumatic gun. The pneumatic gun has a receiver with the first and second loading port disposed to permit loading either by gravity or forced loading such as from a magazine. The barrel can be locked to the receiver to permit loading through only one of the two ports depending on the orientation in which it is locked to the receiver and permits selective loading through only a selected port at any time.

11 Claims, 4 Drawing Sheets

SYSTEM FOR LOADING A PAINTBALL

BACKGROUND

1. Field of the Invention

Invention relates to pneumatic guns. More specifically, the invention relates to a gun and system to provide multiple loading options.

2. Background

Traditional paintball guns have a single loading option. Typically, they are either loaded by gravity feed systems or by forced (magazine) feed systems. Within typical gravity feed systems the paintballs are retained in a large hopper and enter the receiver through a gravity feed channel, which is generally either 90 degrees or 45 degrees from the horizontal. The paintball is loaded by gravity into the breach of the receiver and then ejected by a forced air charge. The magazine feeds generally use a smaller number of paint balls which are forced from beneath the receiver into the breach through a port in the bottom of the receiver and then ejected by a forced air charge. Magazine feeds tend to be more compact and maneuverable than gravity feed systems and is less reliant on the angle at which the gun is held during use. However, magazine systems tend to hold a smaller volume of paintballs before reloading is required. Accordingly, each system has its place within the paintball sport. Unfortunately, traditionally it has been necessary to completely switch guns in the context where a different loading system is desired.

BRIEF DESCRIPTION OF THE DRAWINGS

Embodiments of the invention are illustrated by way of example and not by way of limitation in the figures of the accompanying drawings in which like references indicate similar elements. It should be noted that different references to "an" or "one" embodiment in this disclosure are not necessarily to the same embodiment, and such references mean at least one.

SUMMARY

The plural option loading system for a pneumatic gun is described. The pneumatic gun has a receiver with the first and second loading port disposed to permit loading either by gravity or forced loading such as from a magazine. The barrel can be locked to the receiver to permit loading through only one of the two ports depending on the orientation in which it is locked to the receiver and permits selective loading through only a selected port at any time.

DETAILED DESCRIPTION

Figure 1:
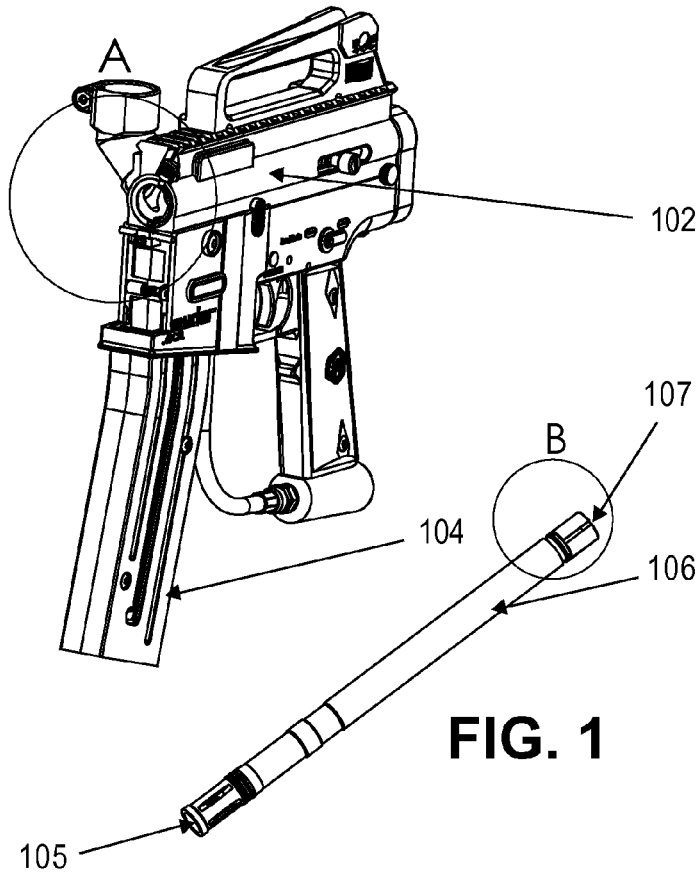
FIG. 1 is a perspective view of a pneumatic gun of one embodiment of the invention with the barrel detached.

FIG. 1 is a perspective view of a pneumatic gun of one embodiment of the invention with the barrel detached. A receiver 102 defines a gravity loading port and a magazine loading port and may be coupled to barrel 106 to permit selective loading through one of the two ports. A magazine 104 may be coupled to receiver 102. The barrel has a distal end 105 and a proximal end 107. Barrel 106 also defines a loading aperture (not shown in FIG. 1). As used herein, distal end refers to the end of the barrel furthest from the receiver when in use and proximal end refers to the end of the barrel connected to the receiver when in use.

Figure 1B:
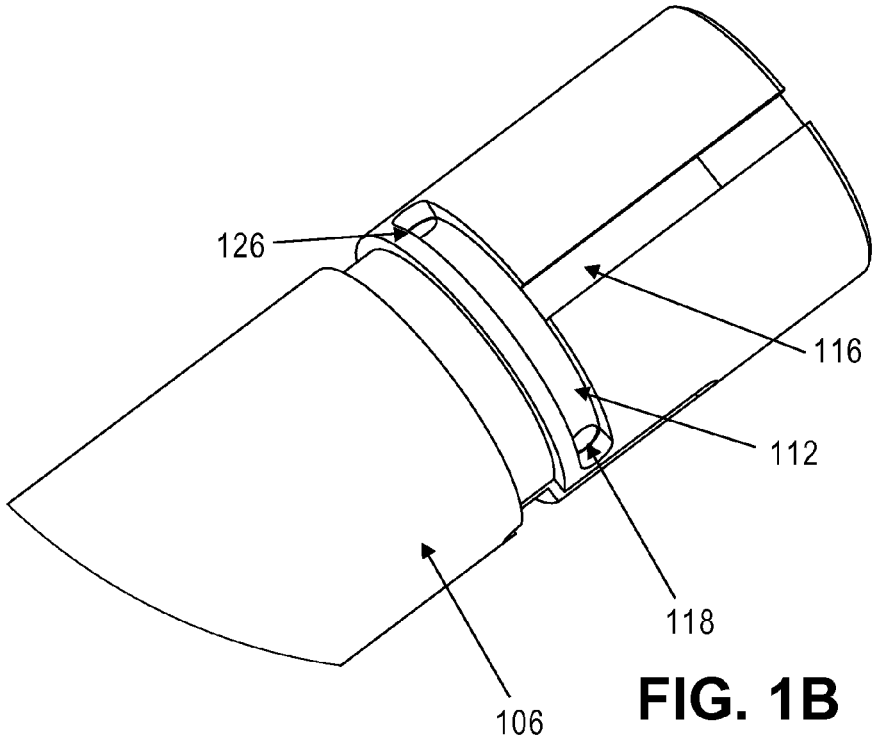
FIG. 1B is a sectional view of one embodiment of the invention with the barrel installed and the loading aperture aligned with the gravity loading port of the receiver.
Figure 1A:
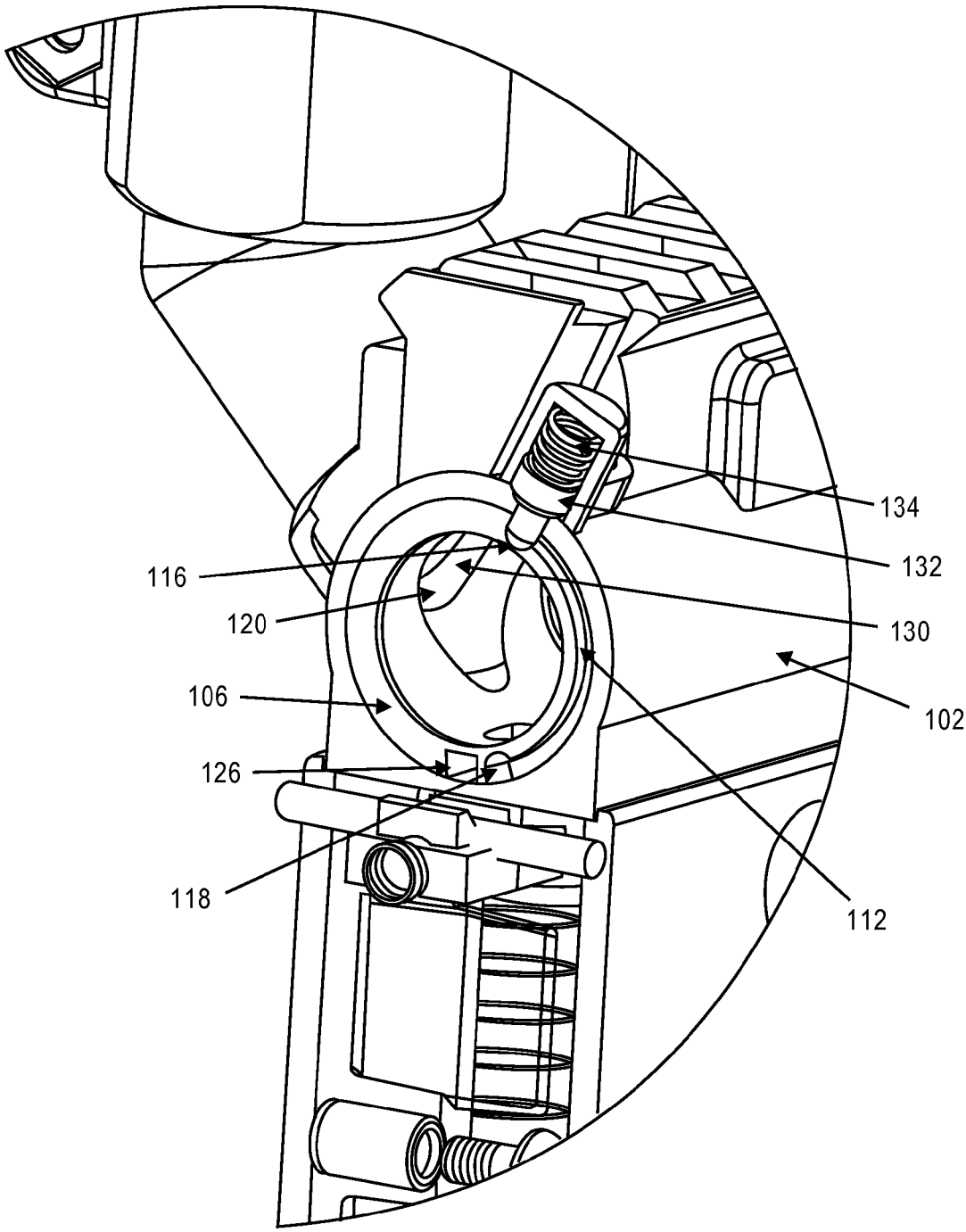
FIG. 1A is an enlarged perspective view of the proximal end of barrel 106.

FIG. 1A is an enlarged perspective view of the proximal end of barrel 106. Barrel 106 defines a circumferential channel 112 and a pair of locking points 116 and 118 at opposing ends of the circumferential channel 112. Barrel 106 further defines an aperture (not shown in FIG. 1A) which aligns with one of the loading ports of receiver 102 when the barrel is installed. Proximal end further defines an entry channel to permit a detent in the receiver to enter circumferential channel 112. Locking points 116 and 118 are defined at opposing ends of circumferential channel 112. In one embodiment, locking points are rounded depressions in the floor of channel 112. In one embodiment, when a detent of receiver (not shown) engages locking point 116, the loading aperture of barrel 106 is aligned with the gravity feed port of receiver 102. When the detent engages locking point 118 the loading aperture aligns with the magazine feeding port of receiver 102.

FIG. 1B is a sectional view of one embodiment of the invention with the barrel installed and the loading port aligned with the gravity loading port of the receiver. In this view, barrel 106 is shown installed in receiver 102. The loading aperture 120 defined in barrel 106 can be seen in alignment with loading port 130 which is the gravity feed loading port of receiver 102. Thus, detent 132 is shown engaged in locking point 116. A bias spring 134 maintains this engagement unless sufficient external force is applied to rotate the barrel. In this figure, the rounded cross section of locking point 118 can be seen. Circumferential channel 112 is shown between the existing engagement of detent 132 in locking point 116 and locking point 118. Because the single loading aperture 120 is defined in barrel 106, when locked in this orientation, feeding from magazine 104 is prevented. Barrel 106 defines an additional channel 126 to orient the barrel 106 for installation or removal from the receiver 102. A user can supply manual force to twist the barrel 106 the rounded end of detent 132 in conjunction with the rounded sides of locking point allows the user to overcome the bias force of spring 134 with this twisting motion. This allows a transition between gravity loading and magazine loading without the use of tools, thus increasing the versatility and usability of a pneumatic gun provided with this loading system.

Figure 2:
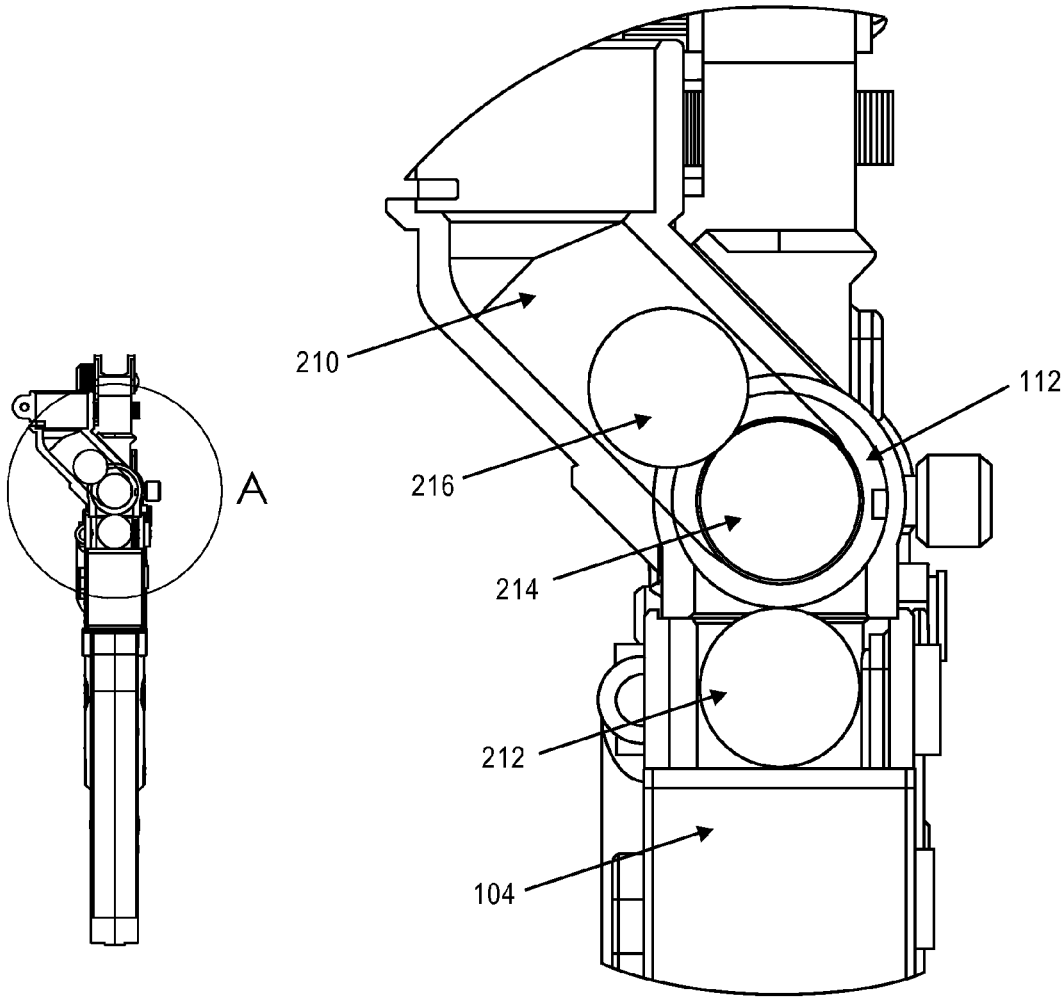
FIG. 2 is a sectional view of a pneumatic gun of one embodiment of the invention in a gravity feed orientation.

FIG. 2 is a sectional view of a pneumatic gun of one embodiment of the invention in a gravity feed orientation. Paintballs such as paintball 216 reside in feeding neck 210. In some embodiments, the feeding neck 210 is at 45 degrees from the vertical. While in other embodiments, feeding neck 210 may be vertical. In the shown embodiment the circumferential channel 112 would extend in a 135 degree arc around the barrel 106. For an embodiment with a vertical gravity feed, the circumferential channel would extend 180 degrees. When in this orientation, paintballs from feeding neck dropped directly into barrel 106 through the loading aperture (120 shown in FIG. 1B). Meanwhile, paintballs such as paintball 212 are prevented from entering the barrel by a solid side of the barrel 106 occluding the forced loading port that corresponds to magazine 104. Detent 132 locks the barrel in a selected orientation until sufficient force is applied to overcome the bias of the detent 132.

Figure 3:
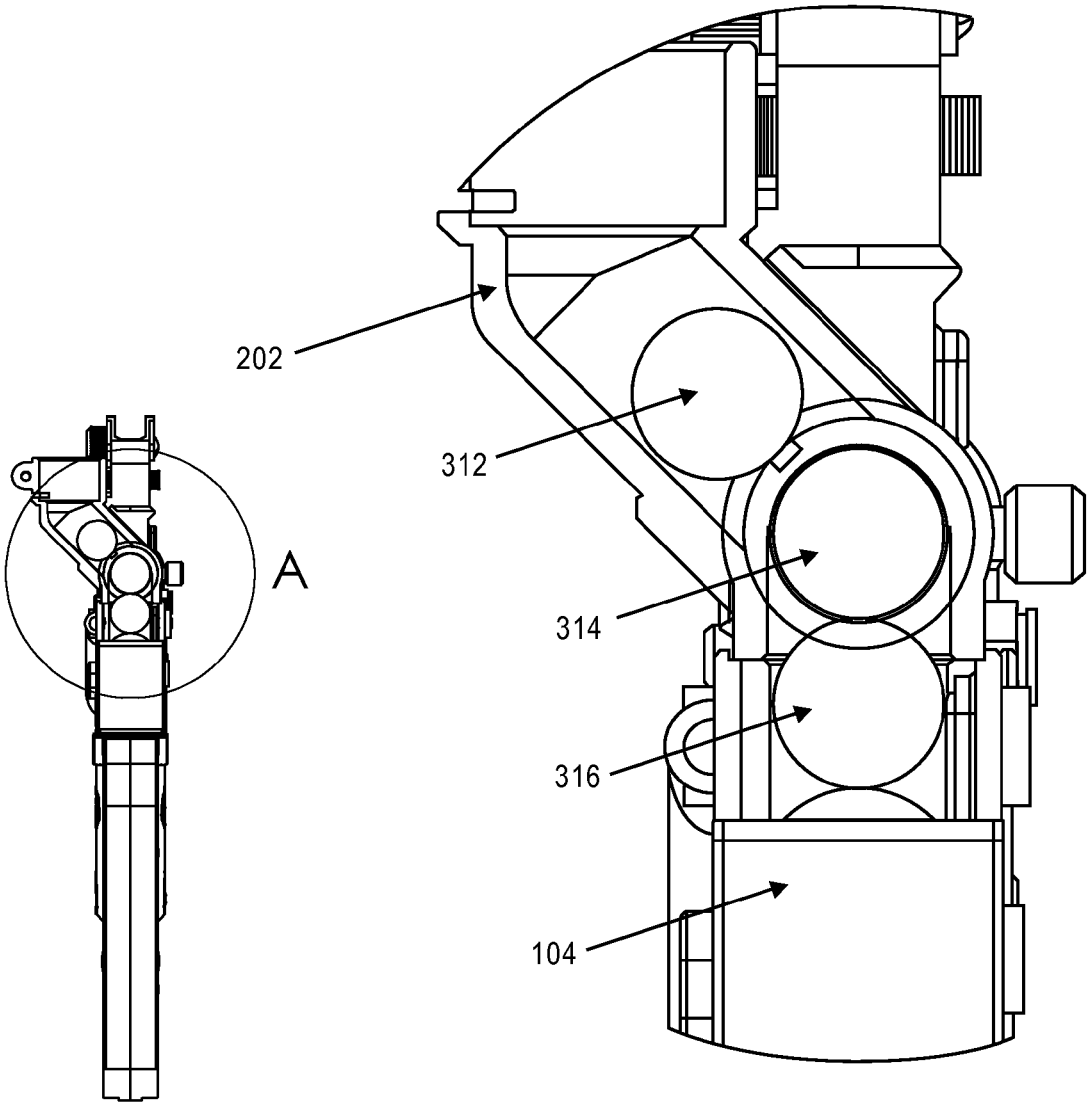
FIG. 3 is a sectional view of a pneumatic gun of one embodiment of the invention in a magazine loading orientation.

FIG. 3 is a sectional view of a pneumatic gun of one embodiment of the invention in a magazine loading orientation. In this orientation, loading aperture (120 in FIG. 1B) is aligned with the magazine loading port and maintained in this orientation by the detent. In this orientation, a paintball in loading neck 202 cannot enter the barrel because gravity loading port (130 from FIG. 1B) is occluded by the solid side of the barrel 106. Meanwhile, paintballs such as paintball 314 can be forced into the barrel from magazine 104. Paintball 316 is shown as next in line and will be forced into the barrel once paintball 314 is ejected.

In the foregoing specification, the embodiments of the invention have been described with reference to specific embodiments thereof. It will, however, be evident that various modifications and changes can be made thereto without departing from the broader spirit and scope of the invention as set forth in the appended claims. The specification and drawings are, accordingly, to be regarded in an illustrative rather than a restrictive sense.

What is claimed is:

1. A pneumatic gun comprising:

a receiver having a first loading port and a second loading port; and a barrel lockable to the receiver to permit loading only through the first port in a first orientation and only through the second port in a second orientation wherein the barrel manually moveable without tools between the first and the second orientation while the magazine is installed.

2. The pneumatic gun of claim 1, wherein the barrel has a proximal end and a distal end, the barrel defining an aperture adjacent to the proximal end and a circumferential channel also adjacent to the proximal end, the channel defining a first locking point and a second locking point.

3. The pneumatic gun of claim 2, further comprising a detent coupled to the receiver and residing in the channel and biased to engage the locking points, wherein when the detent engages the first locking point, the aperture aligns with the first port and when the detent engages the second locking point the aperture aligns with the second port.

4. The pneumatic gun of claim 2 wherein the barrel further defines an entry channel longitudinally disposed and connecting the circumferential channel with the proximal end.

5. The pneumatic gun of claim 3, further comprising a bias spring to bias the detent into engagement.

6. The pneumatic gun of claim 1, wherein the first port permits gravity loading of a projectile and the second port permits force loading of a projectile.

7. The pneumatic gun of claim 2, wherein the locking points comprise rounded depressions in the floor of the circumferential channel.

8. The pneumatic gun of claim 7, wherein the detent has a rounded engagement surface to engage the rounded depressions.

9. A method of loading a pneumatic gun comprising:

selecting between a plurality of loading ports in a receiver;

manually, without tools, twisting a barrel of the pneumatic gun to align an aperture in the barrel with a selected port while a magazine is installed in the receiver; and locking the barrel with the aperture aligned with the selected port.

10. The method of claim 9, wherein locking comprises:

engaging a locking point on the barrel with a detent on the receiver.

11. The method of claim 9, further comprising:

gravity feeding a paintball into the barrel when the first port is selected; and magazine feeding a paintball into the barrel when second port is selected.

* * * * *